United States Patent [19]

Holcombe

[11] Patent Number: 4,574,549

[45] Date of Patent: Mar. 11, 1986

[54] ADJUSTABLE ROOF INSULATION SYSTEM

[75] Inventor: J. L. Holcombe, Colleyville, Tex.

[73] Assignee: Mizell Bros. Co., Altanta, Ga.

[21] Appl. No.: 719,298

[22] Filed: Apr. 3, 1985

[51] Int. Cl.[4] ..... E04B 1/74

[52] U.S. Cl. ..... 52/404; 52/632

[58] Field of Search ..... 52/404, 632, 317, 406, 52/407, 645

[56] References Cited

U.S. PATENT DOCUMENTS

| | | | |
|---|---|---|---|
| 1,412,736 | 4/1922 | Hamilton | 52/317 |
| 3,589,086 | 6/1971 | Schilling | 52/632 X |
| 4,318,260 | 3/1982 | Siegel et al. | 52/407 |
| 4,375,741 | 3/1983 | Paliwoda | 52/407 |
| 4,397,127 | 8/1983 | Mieyal | 52/632 X |
| 4,449,343 | 5/1984 | Henningsen | 52/404 |

*Primary Examiner*—Carl D. Friedman

*Attorney, Agent, or Firm*—Shlesinger, Arkwright, Garvey & Fado

[57] ABSTRACT

An adjustable roof insulation system for metal buildings or the like in which beams serve as the support for a metal roof sheet comprising a series of parallel spaced support units secured to the beams, each comprising a longitudinally extending first member and a longitudinally extending second member, the first and the second members being longitudinally adjustable relative to each other, the first and the second members each having one end supported by the beams and their other ends in contact engagement, the first and the second members having substantially the same cross-sectional configuration and in mating contact engagement at the other ends, means for securing the other ends in adjustable relation, the means having a partial wrap-around configuration for securing the other ends against vertical displacement, means for connecting the beams to the first and the second members to prevent lateral displacement of the members on the beams, the first member having substantial length relative to the second member, the securing means being substantially shorter in length than the second members, and insulation positioned and supported by the first and the second members.

7 Claims, 9 Drawing Figures

ADJUSTABLE ROOF INSULATION SYSTEM

FIELD OF THE INVENTION

This invention generally relates to a roof insulation support system and more particularly to a versatile roof insulation system incorporating a novel network of length adjustable insulation supporting members as well as readily applied fastening members for securing the insulation supporting members in place.

BACKGROUND OF THE INVENTION

To date, numerous attempts have been made in order to achieve low cost, yet versatile insulation systems for application in existing structures as well as for application in new constructions, so as to minimize expenditures associated with heating and cooling of such structures.

One major problem associated with the prior systems is that an excessive amount of time, labor and material is wasted during the installation process due to overly complicated system designs which are not always readily adaptable to the specific dwelling being serviced.

Furthermore, with few exceptions, the stock material must be pre-cut prior to shipment to the construction site or modified at the time of installation at the site.

SUMMARY AND OBJECTS OF THE INVENTION

It is therefore an object of the present invention to provide a roof insulation system which is versatile in order to meet the design specification of the specific dwelling which is to be fitted therewith.

It is another object of the present invention to provide a roof insulation system which is uncomplicated in design and easy to install.

A further object of the present invention is to provide a roof insulation system which is inexpensive to manufacture and to ship to the installation site.

It is still a further object of the present invention to provide a roof insulation system which may be installed during construction of a new building or retrofitted to an existing structure.

These and other objectives are met by the present invention which provides a novel network of interlocking, nestable, insulation supporting, hat-shaped channel members which are adjustable in length, and readily secured to roof supporting structural beams.

BRIEF DESCRIPTION OF THE DRAWINGS

FIGS. 1, 2 and 3

Referring now to FIGS. 1, 2 and 3, the adjustable roof insulation system A includes a plurality of parallel, spaced roof purlins 2 which serve to support a metal roof (not shown) positioned thereon. Purlins 2 include flange portions 4.

Figure 1:
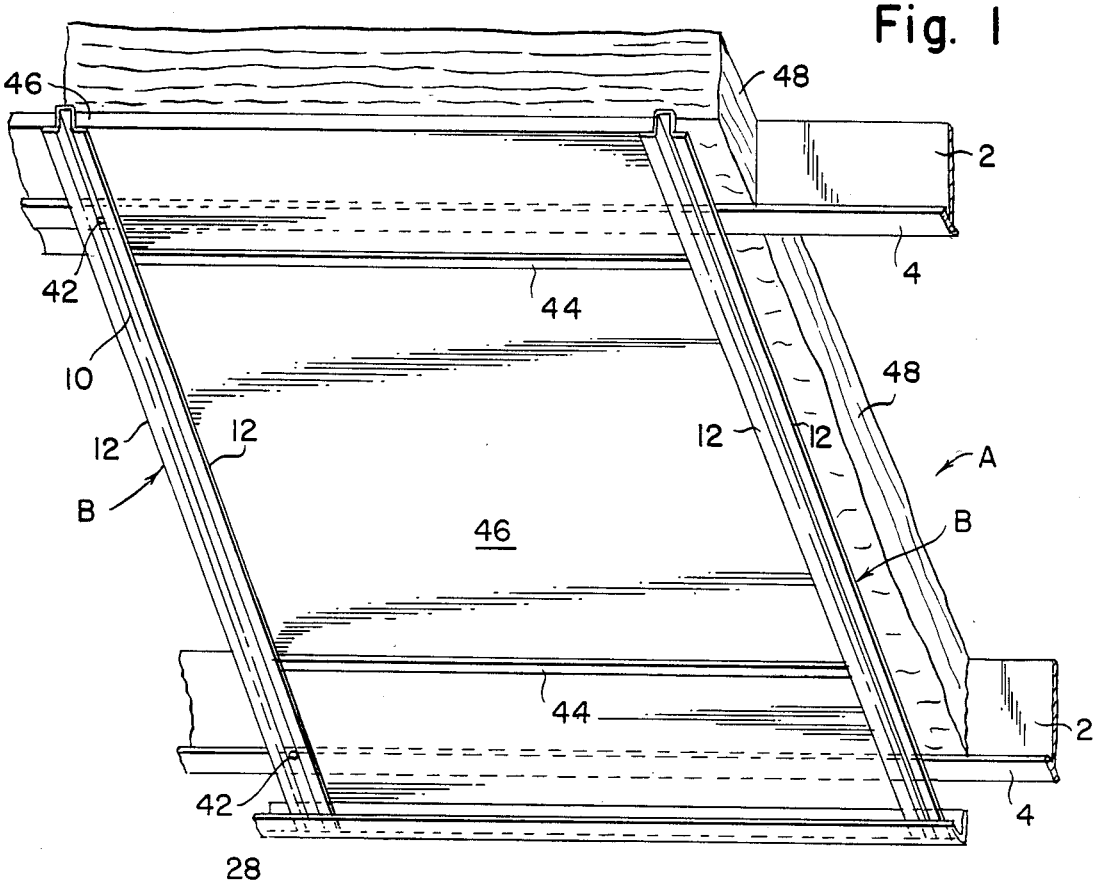
FIG. 1 is a partially fragmented view of an assembled roof insulation system of the present invention including portions shown in dotted lines.

A series of parallel spaced support units B are positioned beneath and secured to purlins 2. Each support unit B is comprised of a longitudinally extending first member 6 having substantial length and a longitudinally extending second starter member 8 of shorter length than member 6. For the purpose of clarity, starter members 8 are not shown in FIG. 1.

Each first member 6 is generally hat-shaped including a flat crown 10 and laterally extending side flanges 12. Each starter member 8 is likewise generally hat-shaped including a flat-crown 14 and laterally extending side flanges 16. One end of each hat-shaped members 6 and 8 are in mating or nested contact engagement. The first and second members 6 and 8 are longitudinally adjustable relative to each other with their mating ends secured against vertical displacement by means of splice clips 18.

Figure 3:
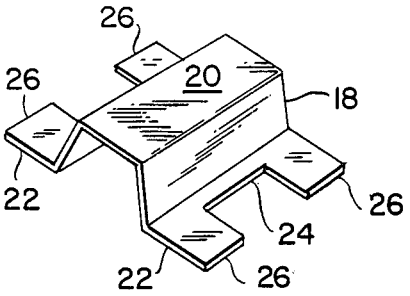
FIG. 3 is a perspective view of an unassembled securing member of FIG. 2.

As shown in FIG. 3, splice clip 18 is generally hat-shaped with a flat crown 20 and laterally extending side flanges 22 which extend a distance beyond laterally extending side flanges 12 and 16 of members 6 and 8, respectively. Each laterally extending flange 22 further includes a generally rectangular shaped notched opening 24 formed therein so as to provide opposed pairs of parallel spaced laterally extending flange portions 26.

Figure 2:
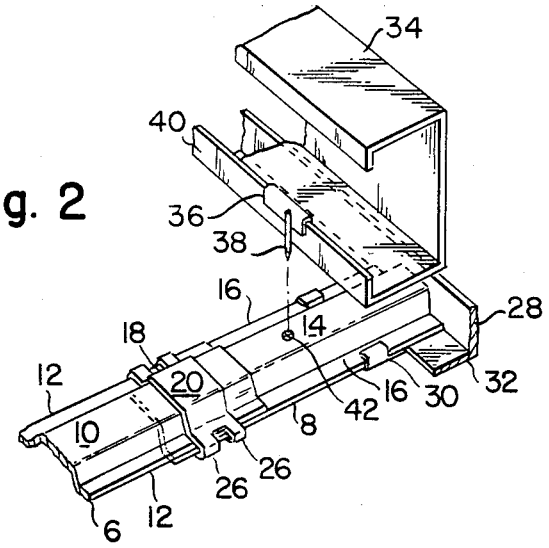
FIG. 2 is a partially fragmented perspective view of a structural unit comprising nested and interlocked hat-shaped channel members assembled at an eave with portions shown in dotted lines.

As shown in FIG. 2, splice clip 18 is positioned in nesting relation over the ends of members 6 and 8 with flange portions 26 partially wrapped around flanges 12 and 16. The provision of starter members 8 and splice clips 18 allows support units B to be readily adjustable in length so as to be positioned between structural members, for example, L-shaped perimeter wall angles 28. Wedge clamps 30 are utilized for securing end portions of support units B to laterally extending flange 32 of perimeter wall angle 28. Wedge clamp 30 will be described in greater detail in conjunction with FIGS. 4 through 6.

FIG. 2 further illustrates interconnection between eave strut 34 and support unit B. A lock clip 36 including clip shank portion 38 is fastened onto flange 40 of eave strut 34. Clip shank portion 38 will subsequently be driven through spindle sinch 42 formed in crown 10 of starter member 8.

Returning now to FIG. 1, it may be seen that adjustable roof insulation system A further includes a series of crossmembers 44 which span support units B. Cross-members 44 include end portions which are situated upon laterally extending flanges 12. Cross-members 44 are provided with laterally extending flanges which are similar in configuration to flanges 12.

Faced fiberglass board segments 46 are positioned between cross-members 44 and support units B with the peripheral edges of each board segment 46 resting upon the laterally extending flanges of cross-members 44 and the laterally extending flanges 12 of support units B. Unfaced fiberglass batts 48 are subsequently positioned over faced board segments 46.

FIGS. 4 through 7

Figure 4:
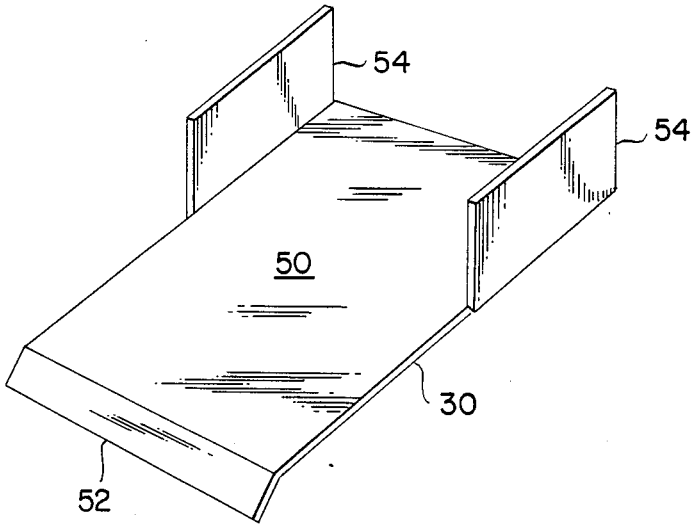
FIG. 4 is a perspective view of a wedge clamp prior to installation.

FIG. 4 shows in detail a wedge clamp 30 which is comprised of a flat base portion 50 and a downwardly sloping ramp portion 52 extending from one end of flat base portion 50. Opposed bendable flange portions 54 extend from either side of flat base portion 50.

Figure 5:
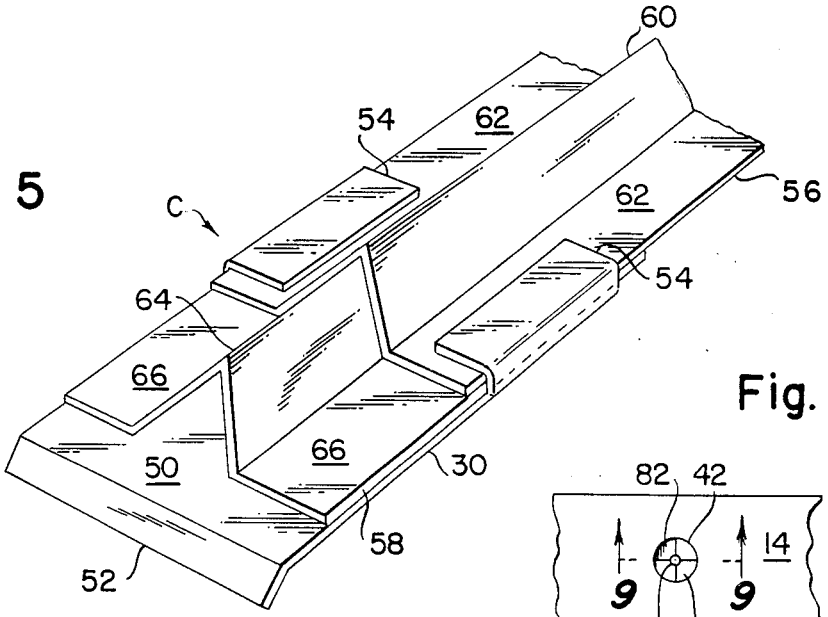
FIG. 5 is a partially fragmented perspective view showing an alternative embodime,nt of the support unit and wedge clamp.

FIG. 5 shows an alternative embodiment of an adjustable length support unit C. Support unit C comprises a longitudinally extending first member 56 and a nestable or mating longitudinally extending starter member 58. First member 56 is generally hatshaped with a pointed crown 60 and laterally extending side flanges 62. Starter member 58 is also generally hat-shaped with a pointed crown 64 and laterally extending side flanges 66. Starter member 58 is shorter in length than first member 56. A wedge clamp 30 is positioned beneath members 56 and 58 with flange portions 54 partially wrapped around flanges 62 and 66 thereby locking support unit C together.

Figure 6:
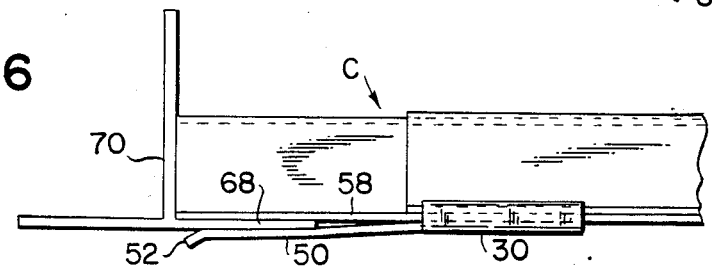
FIG. 6 is a partially fragmented side elevational view showing the elements of FIG. 5 assembled to a structural beam member with portions shown in dotted lines.

In FIG. 6, support unit C of FIG. 5 is positioned for locking engagement with the lower flange 68 of structural member 70. Structural member 70 may be an I-beam or the equivalent thereof. Thus, flange 68 is wedged between base portion 50 of wedge clamp 30 and the base portion of starter member 58. Downwardly sloping ramp portion 52 allows easy separation of base portion 50 from the base of starter member 58 during installation of support unit C onto flange 68.

Figure 7:
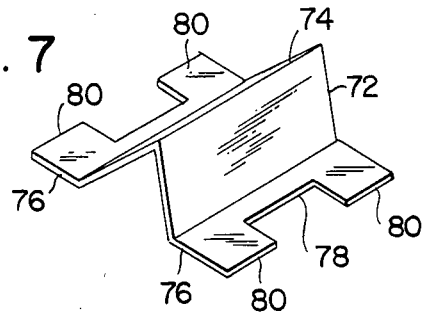
FIG. 7 is a perspective view showing an alternative embodiment of the securing member of FIG. 3.

FIG. 7 shows an alternative embodiment of the splice clip of FIG. 3. Splice clip 72 is generally hat-shaped with a pointed crown 74 and laterally extending side flanges 76. Side flanges 76 would extend laterally a distance beyond laterally extending flanges 62 and 66 of support unit C. In addition, each flange 76 may be provided with a generally rectangular shaped notched opening 78 so as to form opposed pairs of parallel spaced laterally extending flanges 80.Openings 78 permit ease in bending flanges 80.

Splice clip 72 would be assembled upon support unit C in the same manner as splice clip 18 of FIG. 2. It is obvious that splice clip 72 may replace wedge clamp 30 in FIG. 5 for securing members 56 and 58 together or that splice clip 72 may be used in conjunction with wedge clamp 30. In the latter case, the position of wedge clamp 30 would be shifted from the position shown in FIG. 5 so that wedge clamp 30 would rest only under starter member 58.

It should be further noted that support units C may be used in place of cross-members 44 of FIG. 1. In this instance, flanges 12 would be wedged between base portion 50 of wedge clamp 30 and the base of starter member 58.

Figure 8:
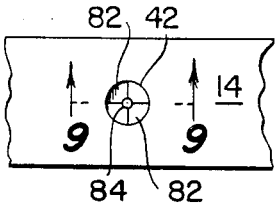
FIG. 8 is a partially fragmented top plan view showing the crown portion of a hat-shaped channel member having a stamped in spindle clinch.
Figure 9:
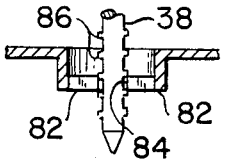
FIG. 9 a partially fragmented cross-section taken on lines 9—9 and viewed in the direction of the arrows.

FIGS. 8 and 9

FIGS. 8 and 9 show detailed views of spindle sinch 42 and clip shank portion 38 as previously described in conjunction with the embodiment of FIG. 2.

Spindle sinch 42 is stamped into the flat crown portion 14 of starter member 8 forming recessed segments 82 and central opening 84. Clip shank portion 38 is provided with projecting members 86 which allow the shank portion to be inserted through opening 84 and locked in place at a predetermined position.

It should be noted that spindle sinch 42 is not limited to starter members 8 of support units B but may also be formed in first members 6.

While this invention has been described in connection with different embodiments thereof, it will be understood that it is capable of further modifications, and this application is intended to cover any variations, uses, or adaptations of the invention following, in general, the principals of the invention and including such departures from the present disclosure as come within known or customary practice in the art to which the invention pertains, and as may be applied to the essential features hereinbefore set forth and followed in the scope of the invention or the limits of the appended claims.

What I claim is:

1. An adjustable insulation system for metal buildings or the like in which beams serve as the support for a metal roof sheet, comprising:

(a) a series of parallel spaced support units secured to said beams, each comprising a longitudinally extending first member and a longitudinally extending second member, (b) said first and said second members being longitudinally adjustable relative to each other, (c) said first and said second members each having one end supported by said beams and their other ends in contact engagement, (d) said first and said second members having substantially the same cross-sectional configuration and in mating contact engagement at said other ends, (e) means for securing said other ends in adjustable relation, (f) said means having a partial wrap-around configuration for securing said other ends against vertical displacement, (g) means for connecting said beams to said first and said second members to prevent lateral displacement of said members on said beams, (h) said first members having substantial length relative to said second members, (i) said securing means being substantially shorter in length than said second members, and (j) insulation positioned and supported by said first and said second members.

2. An adjustable roof insulation system as in claim 1, wherein:

(a) each of said first and said second members are hatshaped with a flat crown and laterally extending side flanges, and, (b) said securing means are hat-shaped with a flat crown and laterally extending side flanges extending a distance beyond said laterally extending side flanges of said first and said second members and capable of being partially wrapped around said side flanges of said first and said second members.

3. An adjustable roof insulation system as in claim 2, wherein:

(a) each of said laterally extending side flanges of said securing means further includes a generally rectangular shaped notched opening formed therein thereby providing said securing means with opposed pairs of parallel spaced laterally extending side flanges.

4. An adjustable roof insulation system as in claim 1, wherein:

(a) each of said first and said second members are hat-shaped with a pointed crown and laterally extending side flanges, and, (b) said securing means are hat-shaped with a pointed crown and laterally extending side flanges extending a distance beyond said laterally extending side flanges of said first and said second members and capable of being partially wrapped around said side flanges of said first and said second members.

5. An adjustable roof insulation system as in claim 4, wherein:

(a) each of said laterally extending side flanges of said securing means further includes a generally rectangular shaped notched opening formed therein providing said securing means with opposed pairs of parallel spaced laterally extending side flanges.

6. An adjustable roof insulation system as in claim 1 and further including:

(a) a support unit-to-beam wedge clamp comprising a flat base portion, a downwardly sloping ramp portion extending from one end of said flat base portion and opposed, bendable flange portions extending from either side of said flat base portion, (b) said flat base portion positionable beneath one or both of said first and said second members at one end thereof, with said bendable flange portions partially wrapped around one or both of said first and said second members, and (c) a portion of said beam being clamped between said flat base portion of said wedge clamp and one of said members.

7. An adjustable roof insulation system as in claim 1 and further including:

(a) a series of cross-members extending transversely between adjacent pairs of said parallel spaced support units for further supporting said insulation.

* * * * *